US010018043B2

(12) United States Patent
Van Stee

(10) Patent No.: US 10,018,043 B2
(45) Date of Patent: Jul. 10, 2018

(54) METHOD FOR PRODUCING A CONSTRUCTION ELEMENT, IN PARTICULAR A TUNNEL ELEMENT, HAVING A WATERTIGHT SEAL

(71) Applicant: Trelleborg Ridderkerk B.V., Ridderkerk (NL)

(72) Inventor: Joel Emmanuel Van Stee, Ridderkerk (NL)

(73) Assignee: Trelleborg Ridderkerk B.V., Ridderkerk (NL)

( * ) Notice: Subject to any disclaimer, the term of this patent is extended or adjusted under 35 U.S.C. 154(b) by 0 days.

(21) Appl. No.: 15/308,794

(22) PCT Filed: May 1, 2015

(86) PCT No.: PCT/EP2015/059619

§ 371 (c)(1),
(2) Date: Nov. 3, 2016

(87) PCT Pub. No.: WO2015/169707

PCT Pub. Date: Nov. 12, 2015

(65) Prior Publication Data

US 2017/0175527 A1 Jun. 22, 2017

(30) Foreign Application Priority Data

May 6, 2014 (NL) ..... 2012765

(51) Int. Cl.
*E02D 29/073* (2006.01)
*E21D 11/38* (2006.01)
(Continued)

(52) U.S. Cl.
CPC ..... *E21D 11/385* (2013.01); *E02D 29/063* (2013.01); *E02D 29/073* (2013.01);
(Continued)

(58) Field of Classification Search
CPC ..... E02D 29/073; E02D 29/063; E21D 11/38; E21D 11/385; E21D 11/08; E21D 11/083; E21D 11/086
(Continued)

(56) References Cited

U.S. PATENT DOCUMENTS 1,774,664 A * 9/1930 Parmley ..... E02D 29/073 138/145
3,111,811 A * 11/1963 Eggink ..... E02D 29/073 138/145
(Continued)

FOREIGN PATENT DOCUMENTS

CN 1222947 7/1999
CN 1730844 2/2006
(Continued)

OTHER PUBLICATIONS

Trelleborg Ridderkerk, Gina Gasket Contents, Nov. 13, 2009, www.trelleborg.com/upload/Infrastructure/Files/Gina Gasket.pdf.

*Primary Examiner* — Frederick L Lagman
(74) *Attorney, Agent, or Firm* — Marcus C. Dawes; Daniel L. Dawes

(57) ABSTRACT

Method for producing a construction element, in particular a tunnel element, from a curing material, such as concrete, in a mold, said construction element being provided with a watertight seal on at least one side thereof, wherein a gasket is used comprising a deforming body which is produced from a yielding material, such as rubber. According to the invention a base is produced from a relatively strong material, which base may or may not be detachable from the deforming body. Said base with or without said deforming body is placed against an inner side of the mold, said curing material is cast in the mold, and said curing material is cured to form said construction element with said watertight seal.

8 Claims, 6 Drawing Sheets

(51) Int. Cl.
*E21D 11/08* (2006.01)
*E02D 29/063* (2006.01)

(52) U.S. Cl.
CPC ..... *E21D 11/086* (2016.01); *E21D 11/08* (2013.01); *E21D 11/383* (2013.01)

(58) Field of Classification Search
USPC ..... 405/135, 152
See application file for complete search history.

(56) References Cited

U.S. PATENT DOCUMENTS 3,729,939 A * 5/1973 Shimizu ..... E02B 3/16 277/608
3,750,411 A * 8/1973 Shimizu ..... E02D 25/00 277/608
3,861,154 A * 1/1975 Cooper ..... E21D 11/05 405/152
4,318,636 A * 3/1982 Thomas ..... E21D 11/083 405/150.1
5,035,538 A * 7/1991 Mitchell ..... E21D 11/08 405/150.1
5,888,023 A * 3/1999 Grabe ..... E21D 11/385 277/626
6,129,485 A * 10/2000 Grabe ..... E21D 11/385 277/626
6,238,139 B1 * 5/2001 Glang ..... E21D 11/385 405/135
2012/0301224 A1 * 11/2012 Peters ..... E21D 11/08 405/152

FOREIGN PATENT DOCUMENTS

| | | | | |
|---|---|---|---|---|
| CN | 103291320 | | 9/2013 | |
| CN | 103437791 | | 12/2013 | |
| CN | 103670451 | | 3/2014 | |
| CN | 103670452 | | 3/2014 | |
| DE | 3800630 | | 7/1989 | |
| EP | 0624714 | A2 * | 11/1994 | ..... E21D 9/0607 |
| EP | 1054204 | | 11/2000 | |
| EP | 2666959 | | 11/2013 | |
| FR | 2712655 | | 5/1995 | |
| GB | 2251203 | | 7/1992 | |
| GB | 2330156 | A * | 4/1999 | ..... E21D 11/08 |
| JP | 2005146698 | | 6/2005 | |
| WO | WO-9816721 | | 4/1998 | |
| WO | 98/33988 | | 8/1998 | |
| WO | WO 2005/024183 | * | 3/2005 | ..... E21D 11/08 |
| WO | WO-2013053452 | | 4/2013 | |

* cited by examiner

METHOD FOR PRODUCING A CONSTRUCTION ELEMENT, IN PARTICULAR A TUNNEL ELEMENT, HAVING A WATERTIGHT SEAL

The invention relates to a method for producing a construction element, in particular a tunnel element, from a curing material, such as concrete, in a mould, said construction element being provided with a watertight seal on at least one side thereof, using a gasket which is produced from a yielding material, such as rubber.

An immersed tunnel is normally constructed from structural concrete elements approximately 100-150 meters long, which are manufactured in a casting basin or dry dock. The tunnel elements are provided with temporary bulkheads at both ends to ensure that the element is watertight and capable of floating. On one end of each tunnel element, an endless gasket is mounted. When manufacturing of the tunnel elements is completed, the dock is flooded and the elements floated. Each element is towed to its final position and then immersed. The immersed tunnel element is then pulled firmly up against the preceding immersed element with hydraulic jacks. The initial contact of the gasket should be accomplished using a low pulling force. When the gasket has full contact around the total circumference of the adjacent element, the water between the bulkheads is pumped out. Due to pressure differential between the bulkheads and the hydrostatic pressure on the outside of the tunnel, the gasket profile compresses and seals the joint. A secondary seal is then clamped across the joint on the inside of the tunnel. In general the bulkheads are removed after approval of the pressure test between the gasket and the secondary seal.

The supplier of the gasket needs to show by calculations based on the measured force-compression curves that at all water pressures the selected gasket satisfies the following conditions within agreed safety limits:

1. transfer of the hydrostatic loads at high water level is within the maximum compression capacity of the gasket profile;
2. sealing at all water levels for all joints, including the effect of gap variations due to variation in smoothness/flatness of the tunnel faces, rotation of immersed tunnel elements, creep and shrinkage of the concrete material and temperature effects;
3. restoring moments to re-align misalignment of a tunnel element;
4. proper functioning of the gasket after re-alignment with respect to prevention of leakage at the gap opening side and prevention of overload at the gap closing side;
5. sealing properties should incorporate the effect of relaxation on the rubber material of the seal over the tunnel life time period; and
6. the gasket flange construction should be able to withstand additional loads without dislocation, due to shear of the compressed gasket in case of differential tunnel settlement.

According to prior art methods, the gaskets are mounted on the ends of the tunnel element using an end frame which is first attached to the ends of the tunnel element, and then one side of the gasket is mounted in the frame. The end frame is usually made of carbon steel or stainless steel. Mounting the end frames to the tunnel elements and mounting the gasket in the frames is however time consuming.

The aim of the invention is to provide a cheap, reliable and fast manner to produce and place construction elements such as tunnel elements.

According to the invention a gasket is produced comprising a deforming body which is produced from a yielding material, such as rubber, and a base which is produced from a relatively strong material, which base may or may not be detachable from the deforming body, wherein said base with or without said deforming body is placed against an inner side of the mould, said curing material is cast in the mould, and said curing material is cured to form said construction element with said watertight seal. In this manner the steel end-frames are eliminated and separate installation of the gasket is no longer required.

In a preferred embodiment said base is provided with anchors on one side thereof, said anchors extending into the curing material while said material is cured. A chemical and or mechanical bond can therefore be obtained. Said anchors are preferably made of metal or carbon.

In a first further preferred embodiment said anchors extend from a plate which is at least partially surrounded by said yielding material of the gasket in order to hold said plate. Said plate is also preferably made of metal or carbon. Said anchors comprise bolts, which are screwed into said plate so as to extend therefrom.

In a second further preferred embodiment said anchors are plate shaped, wherein said plate shaped elements extend in or on the curing material parallel to the surface of the curing material.

Said construction element may be a tunnel element, a dry dock element, a storm surge barrier element, an offshore mooring element or a grout seal element.

The invention also relates to a construction element, in particular a tunnel element, produced by the method as described before.

The invention furthermore relates to a tunnel element produced by the method as described before, wherein said gasket is an endless gasket.

The invention furthermore relates to a tunnel wherein tubular tunnel elements produced by the method as described before are placed against one another with said seal in between the outer ends thereof. Preferably a secondary seal is provided over said seal against the inner side of said tunnel.

The invention will now be elucidated by means of preferred embodiments, as shown in the drawings, wherein.

Figure 1:
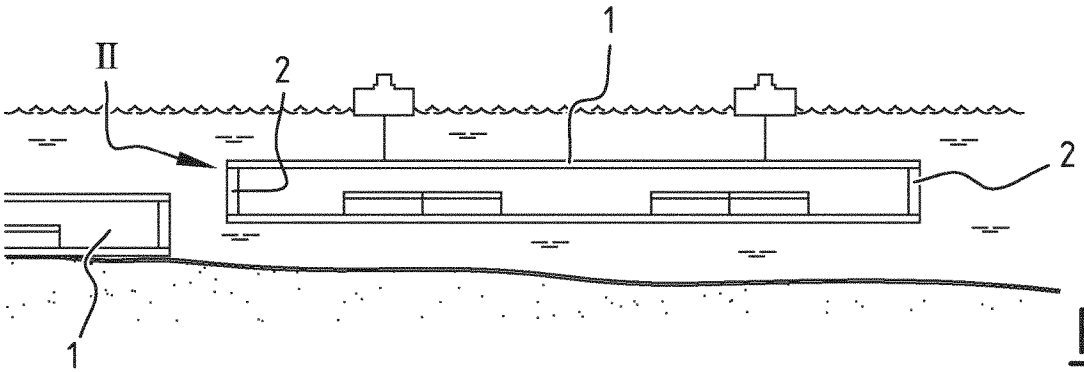
FIG. 1 shows a cross section of an immersed tunnel being built from tunnel elements.
Figure 2:
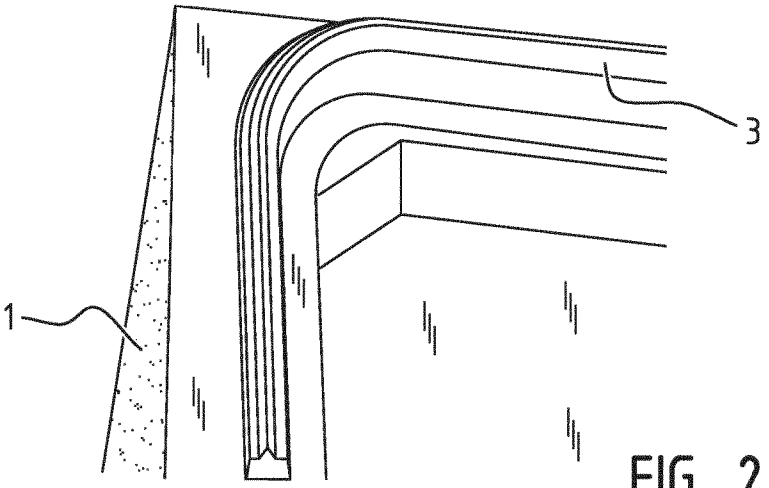
FIG. 2 is a perspective view of detail of an outer end of a tunnel element as indicated by arrow II in FIG. 1.
Figure 3:
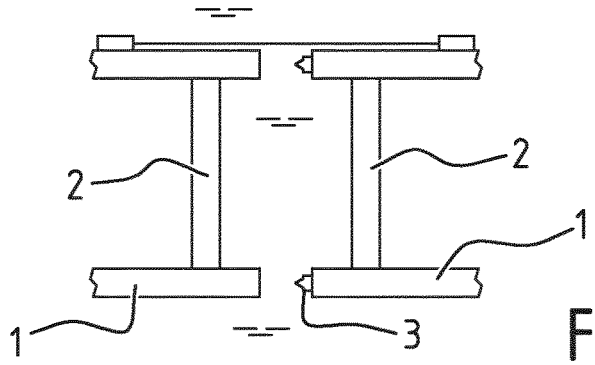
FIGS. 3, 4, 5 and 6 show various stages of the process of placing and sealing the outer ends of the tunnel elements of FIG. 1.
Figure 4:
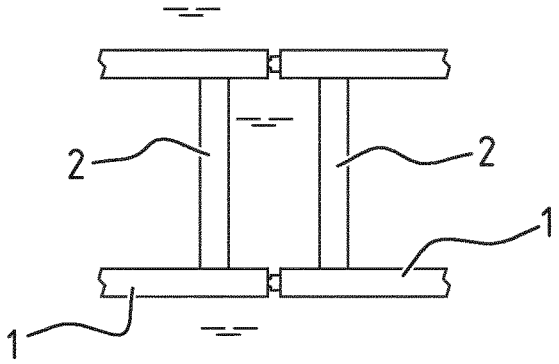
Figure 5:
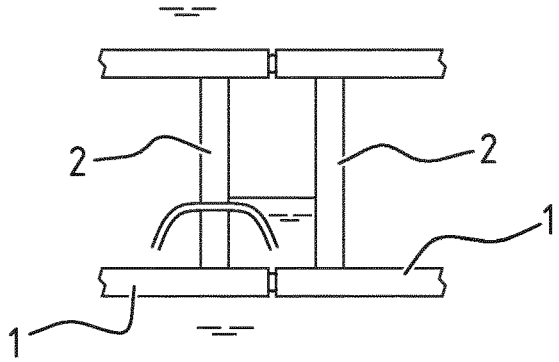
Figure 6:
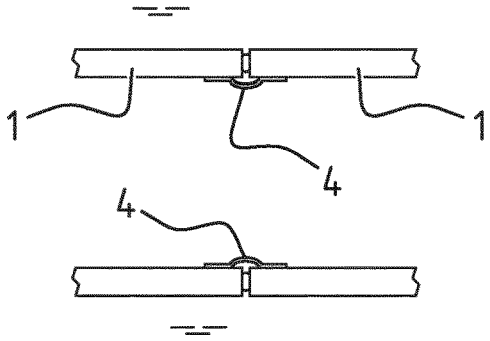

According to FIG. 1 an immersed tunnel is constructed from structural concrete tunnel elements 1. The tunnel elements 1 are provided with temporary bulkheads 2 at both ends to ensure that the element is watertight and capable of floating. Each tunnel element 1 is towed to its final position and then immersed. As shown in FIGS. 2 and 3, on one end of each tunnel element 1, an endless gasket 3 is mounted. The immersed tunnel element 1 is pulled firmly up against the preceding immersed tunnel element 1, as shown in FIG. 4. When the gasket 3 has full contact around the total circumference of the adjacent tunnel element 1, the water between the bulkheads 2 is pumped out as shown in FIG. 5. Due to pressure differential between the bulkheads 2 and the hydrostatic pressure on the outside of the tunnel elements 1, the gasket profile compresses and seals the joint. A secondary seal 4 is then clamped across the joint on the inside of the tunnel elements 1. The bulkheads 2 are then removed as shown in FIG. 6.

Figure 7:
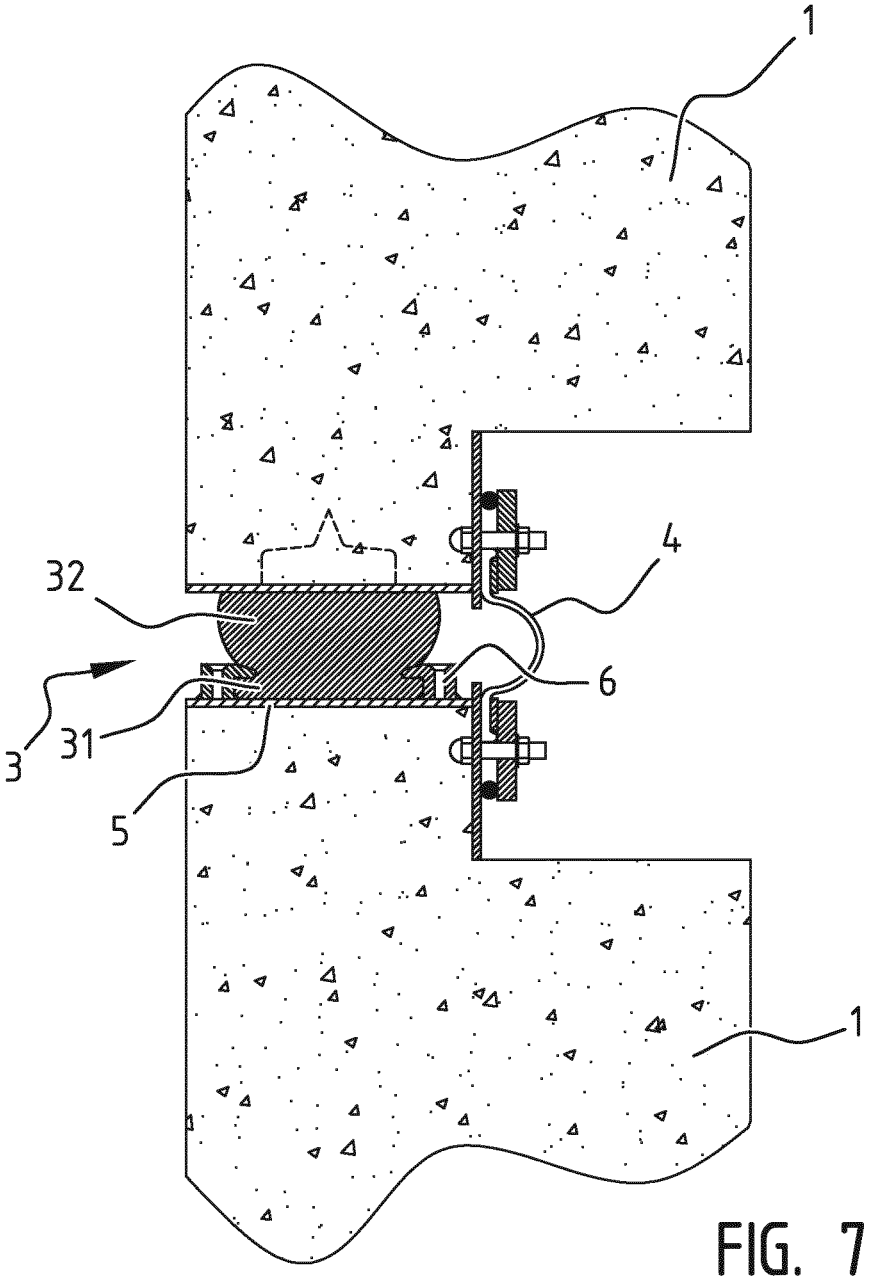
FIG. 7 is a detail of the cross section as shown in FIG. 6 showing a prior art seal.

FIG. 7 shows a prior art seal of the joint between two tunnel elements 1. In this embodiment the endless gasket 3 is profiled, having a base mounting portion 31 and a compressing body 32. Between the mounting portion 31 and the compressing body 32 a slot is provided at both sides of the gasket 3, in which metal strips can engage in order to hold the gasket 3.

According to the prior art, the method for mounting the gasket to the tunnel element 1 is as follows. First an end-frame 5 is provided on the outer end of the cured concrete tunnel element 1. Then the endless gasket 3 is laid out in the correct rectangular shape, flat on a floor (for instance the roof of the tunnel element 1. A lifting beam with nylon straps engages the top section and the lower section of the gasket 3, and the gasket 3 is lifted to the vertical position. The gasket 3 is placed in front of and against the end-frame 5 on the outer end of the tunnel element 1, and on both side of the gasket 3 a metal hooked profiled mounting strip 6 is inserted in the slot between the mounting portion 31 and the compressing body 32, whereafter the mounting strips 6 are attached to the end-frame 5 by means of bolts.

In accordance with the invention, the gasket 3 is directly casted with the tunnel element, eliminating the steel end-frame 5 and mounting strips 6 as shown in FIG. 7. Separate installation is no longer required. The gasket 3 is placed in a special mould. This mould is used to cast the front section of the tunnel element 1. After curing of the concrete and releasing of the mould the gasket 3 is permanently connected with the tunnel element 1.

Figure 8:
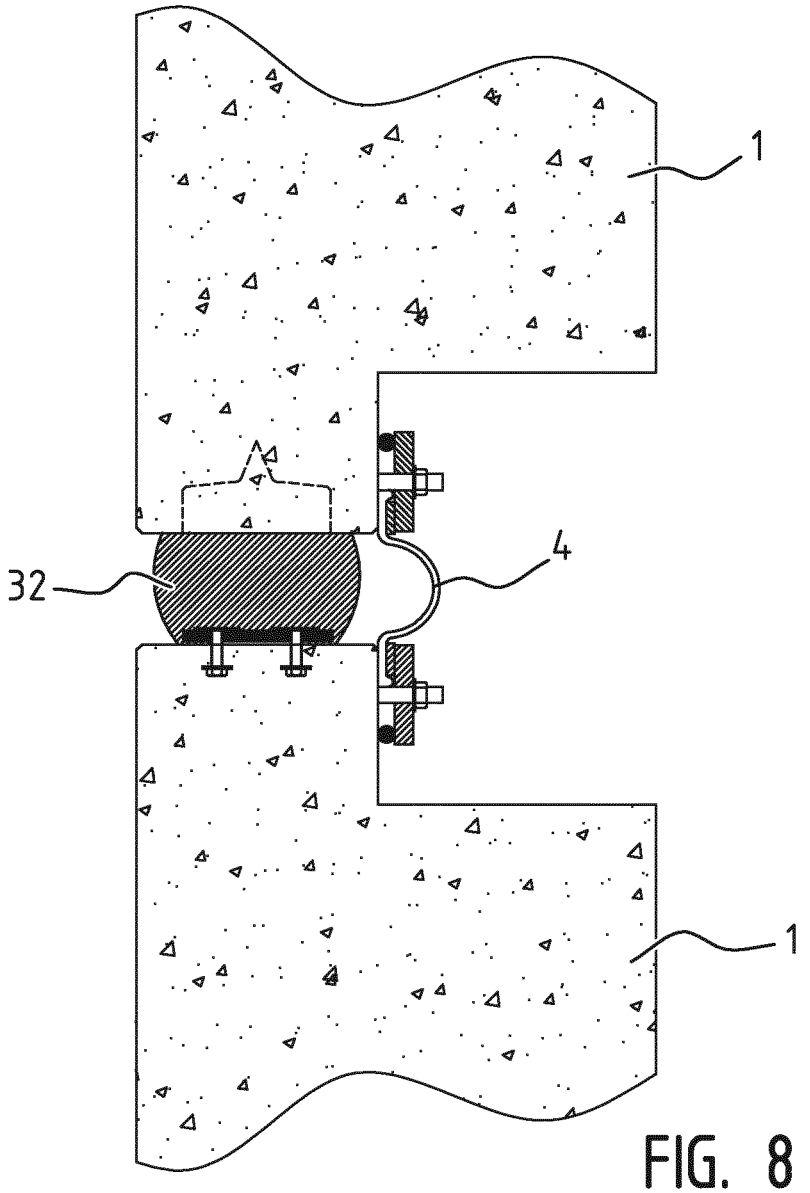
FIG. 8 is a detail of the cross section as shown in FIG. 6 showing a seal in accordance with the invention.
Figure 10:
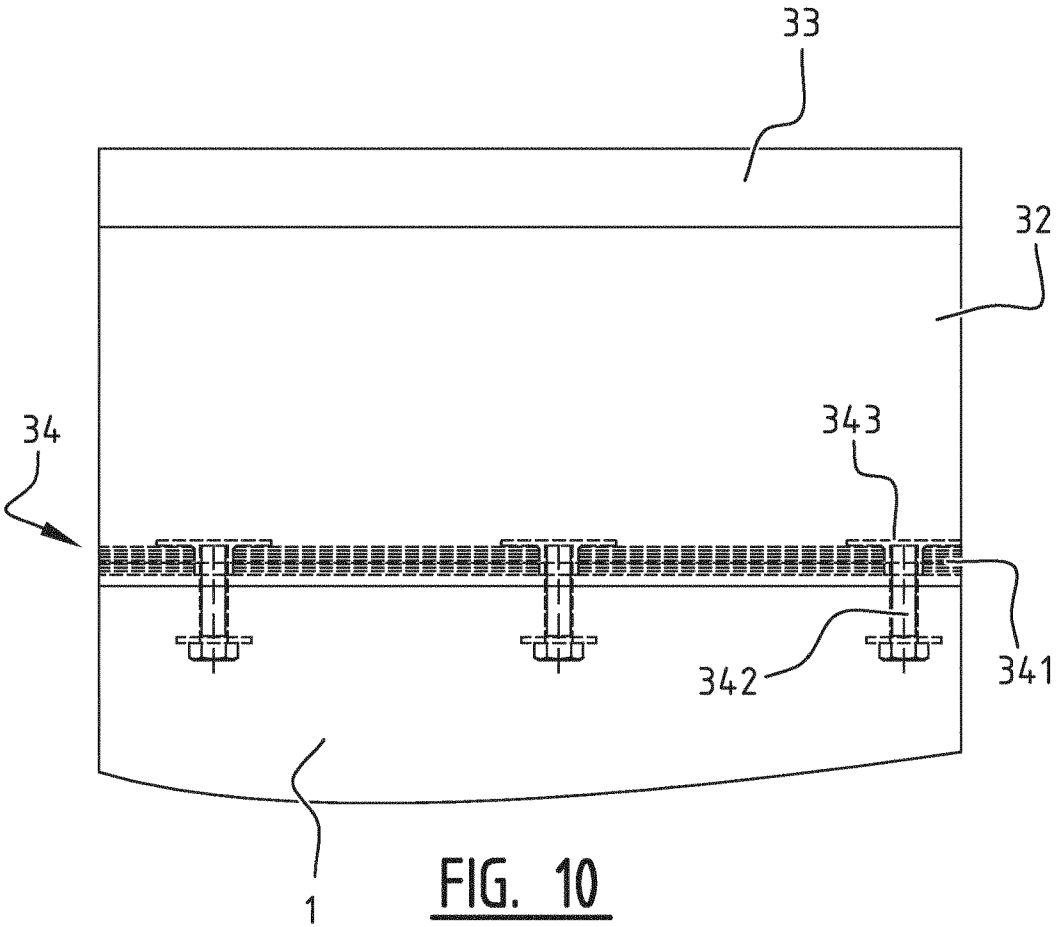
FIG. 10 is a longitudinal cross section of the seal as shown in FIG. 8 before the outer ends of the tunnel elements are placed and sealed.
Figure 9:
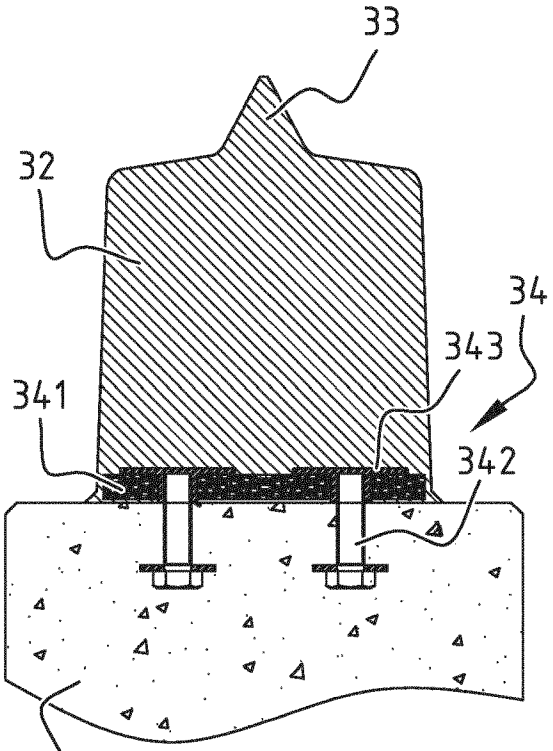
FIG. 9 is a sectional cross section of the seal as shown in FIG. 8 before the outer ends of the tunnel elements are placed and sealed.

In the embodiment of FIGS. 8, 9 and 10 the gasket 3 comprises an endless compressing body 32 made from vulcanized rubber. The compressing body has a generally rectangular, almost square and slightly tapering, cross section. On the side of the compressing body 32 intended to contact the opposing tunnel element 1, which is the smallest of the two opposing sides, a rib 33 is formed which can be easily be deformed upon first contact with the opposing tunnel element 1. On the other side, which is the largest of the two opposing sides, base elements 34 comprising plate shaped elements 341 are enclosed in the rubber material near or at the surface of the compressing body 32. In this embodiment the base elements 34 and the deforming body 32 are not detachable from each other thereby. In this example the plate shaped element 341 is made of carbon fibre or fabric inlay material. Over the length of the plate shaped element 34 pairs of bolts 342 with bolt heads are screwed through the plate shaped element 341, so as to form anchors. On the other side of the plate shaped elements 34 the bolts 342 are secured by nuts 343. The base elements 34 together with the deforming body 32 are cast integral with the concrete in accordance with the invention.

Figure 11:
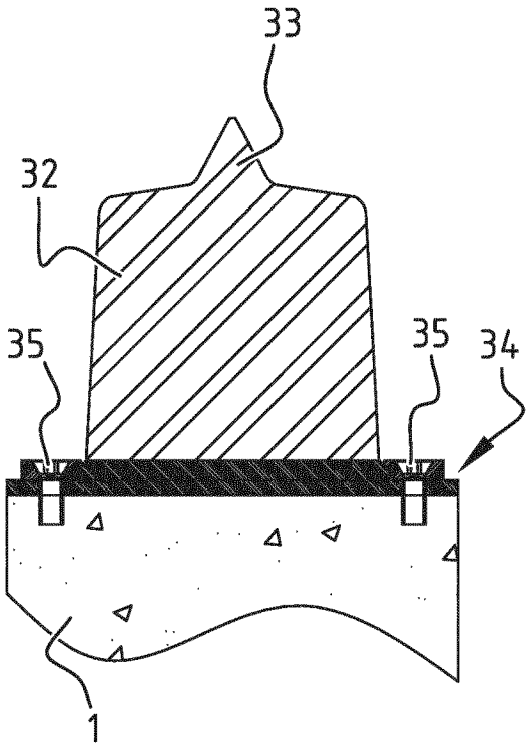

In the embodiment of FIG. 11 the gasket 3 comprises an endless compressing body 32 made from vulcanized rubber. The compressing body 32 has a generally rectangular, almost square and slightly tapering, cross section. On the side of the compressing body 32 intended to contact the opposing tunnel element 1, which is the smallest of the two opposing sides, a rib 33 is formed which can be easily be deformed upon first contact with the opposing tunnel element 1. On the other side, which is the largest of the two opposing sides, plate shaped mounting elements 321 are formed integral with the compressing body 32. Base elements 34 in the form of plate shaped elements are cast integral with the concrete of the tunnel elements in accordance with the invention. The base 34 and the compressing body 32 are detachable from each other and are attached to each other by means of screws 35.

Figure 12:
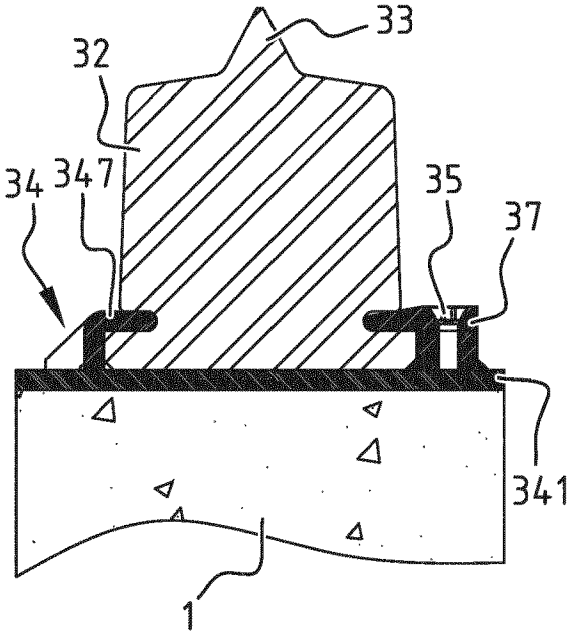

In the embodiment of FIG. 12 the gasket 3 comprises an endless compressing body 32 made from vulcanized rubber. The compressing body 32 has a generally rectangular, almost square and slightly tapering, cross section. On the side of the compressing body 32 intended to contact the opposing tunnel element 1, which is the smallest of the two opposing sides, a rib 33 is formed which can be easily be deformed upon first contact with the opposing tunnel element 1. On the other side, which is the largest of the two opposing sides, the compressing body is formed with a base mounting portion 31. Between the mounting portion 31 and the compressing body 32 a slot is provided at both sides of the compressing body 32, in which metal strips can engage in order to hold the compressing body 32. Base elements 34 comprising plate shaped elements 341 are cast integral with the concrete of the tunnel elements in accordance with the invention. The base element 34 further comprises a metal hooked profiled mounting strip 347 mounted on the plate shaped element 341 which can be inserted in the slot between the mounting portion 31 and the compressing body 32. The base 34 and the compressing body 32 are thus detachable from each other and are attached to each other by means of a separate metal hooked profiled mounting strip 37 which can be mounted on the plate shaped element 341 by means of screws 35.

Figure 13:
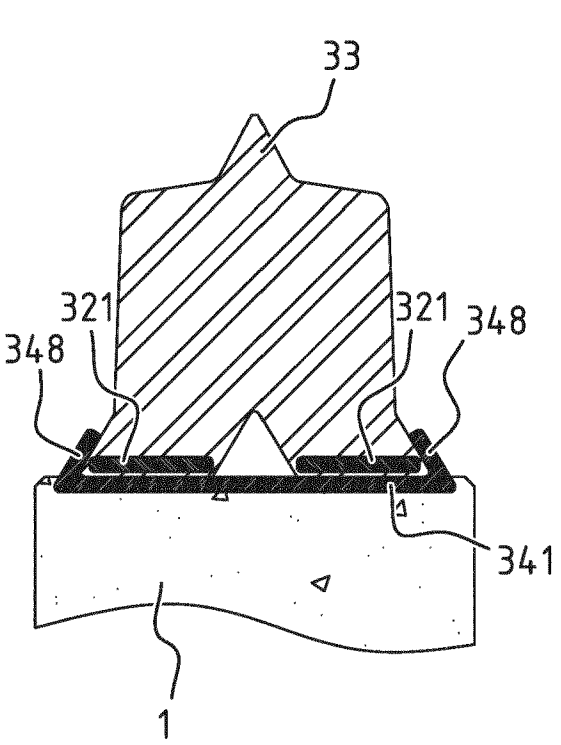
FIGS. 11, 12 and 13 are sectional cross sections of alternative embodiments of seals in accordance with the invention.

In the embodiment of FIG. 13 the gasket 3 comprises an endless compressing body 32 made from vulcanized rubber. The compressing body 32 has a generally rectangular, almost square and slightly tapering, cross section. On the side of the compressing body 32 intended to contact the opposing tunnel element 1, which is the smallest of the two opposing sides, a rib 33 is formed which can be easily be deformed upon first contact with the opposing tunnel element 1. On the other side, which is the largest of the two opposing sides, plate shaped mounting elements 321 are formed integral with the compressing body 32, on both sides of the centre line. On the centre line of said side a V-shaped recess is provided, which allows for manual inward compression of the sides of the compressing body. Base elements 34 comprising plate shaped elements 341 are cast integral with the concrete of the tunnel elements in accordance with the invention. From the edges of the plate shaped element 341 extend strips 348 in the direction of the central-top part of the compressing body. The base 34 and the compressing body 32 are detachable from each other and are attached to each other by compressing the lower part of the compressing body 32 such that it can snap behind the edges of the strips 348 as shown in FIG. 13.

Apart from immersed tunnels, the invention also applies to other construction elements, such as:

Dry dock sealing: dock doors are closed and opened either mechanical or due to hydrostatic water pressure. The pressure acting on the gaskets mounted on these doors are compressing the gasket resulting in a watertight seal.

Storm surge barriers.

Offshore mooring devices. Seals are mounted on a flat surface in a closed circuit connected to a ships hull result into a differential pressure. This differential pressure is used to keep the mooring device in place and connected through a "soft" joint.

Grout sealing. The seal is used to create a void which can be grouted. Once the grout has hardened the seal becomes obsolete.

General sealing purposes.

The invention has thus been described by means of preferred embodiments. It is to be understood, however, that this disclosure is merely illustrative. Various details of the structure and function were presented, but changes made therein, to the full extent extended by the general meaning of the terms in which the appended claims are expressed, are understood to be within the principle of the present invention. The description and drawings shall be used to interpret the claims. The claims should not be interpreted as meaning that the extent of the protection sought is to be understood as that defined by the strict, literal meaning of the wording used in the claims, the description and drawings being employed only for the purpose of resolving an ambiguity found in the claims. For the purpose of determining the extent of protection sought by the claims, due account shall be taken of any element which is equivalent to an element specified therein.

The invention claimed is:

1. A method for producing a tubular tunnel element from concrete, in a mould, said tubular tunnel element being provided with a watertight seal on at least one axial outer end thereof, comprising the following steps:

producing an gasket comprising deforming body which is disposed around a cross-sectional circumference of the tubular tunnel element and which is produced from a yielding material, such as rubber, and a corresponding base disposed beneath the deforming body which is produced from a relatively strong material;

placing said base with said deforming body against an inner side of the mould;

casting said concrete in the mould; and curing said concrete to form said tubular tunnel element with said watertight seal, wherein the base comprises a plurality of anchors on one side thereof which extend from the base into the concrete while said concrete is cured, wherein the tubular tunnel element is configured to form an immersed tunnel when a plurality of tubular tunnel elements are placed against one another with a watertight seal in between the axial outer ends thereof, and wherein the anchors are made of metal or carbon.

2. The method according to claim 1, wherein said anchors extend from a plate, wherein the plate is at least partially surrounded by said yielding material of the gasket in order to hold said plate.

3. The method according to claim 2, wherein said plate is made of metal or carbon.

4. The method according to claim 2, wherein said anchors comprise bolts, which are screwed into said plate so as to extend therefrom.

5. The method according to claim 1, wherein said anchors are plate shaped, wherein said plate shaped elements extend in the curing material parallel to the surface of the curing material.

6. A tunnel element being provided with a watertight seal on at least one axial outer end thereof, produced by a method comprising the following steps:

producing a gasket with a deforming body which is disposed around a cross-sectional circumference of the tunnel element and which is produced from a yielding material, such as rubber, and a corresponding base disposed beneath the deforming body which is produced from a relatively strong material;

placing said base with said deforming body against an inner side of the mould;

placing said concrete in the mould; and curing said concrete to form said tubular tunnel element with said watertight seal, wherein the base comprises a plurality of anchors on one side thereof which extend from the base into the concrete while said concrete is cured, wherein the tunnel element is configured to form an immersed tunnel when a plurality of tunnel elements are placed against one another with a watertight seal in between the axial outer ends thereof, and wherein the anchors are made of metal or carbon.

7. An immersed tunnel comprising tubular tunnel elements being provided with a watertight seal on at least one axial outer end thereof, which tunnel elements are produced by the following steps:

producing a gasket with a deforming body which is disposed around a cross-sectional circumference of the tubular tunnel element and which is produced from a yielding material, such as rubber, and a corresponding base disposed beneath the deforming body which is produced from a relatively strong material, placing said base with said deforming body against an inner side of the mould;

casting said concrete in the mould; and curing said concrete to form said tubular tunnel element with said watertight seal, wherein the base comprises a plurality of anchors on one side thereof which extend from the base into the concrete while said concrete is cured, wherein the tubular tunnel elements are placed against one another forming a joint with said seal in between the axial outer ends thereof, wherein the anchors are made of metal or carbon, and wherein the deforming body is configured to compress and seal the joint between the said tubular tunnel elements under the pressure differential between the interior of the tunnel elements and the hydrostatic pressure on the outside of the tunnel elements.

8. A tunnel according to claim 7, wherein a secondary seal is provided over said seal against the inner side of said tunnel.

* * * * *